US005644855A

United States Patent [19]

McDermott et al.

[11] Patent Number: 5,644,855

[45] Date of Patent: Jul. 8, 1997

[54] CRYOGENICALLY PURGED MINI ENVIRONMENT

[75] Inventors: Wayne Thomas McDermott, Allentown; Richard Carl Ockovic, Northampton; Robert William Wimmer, II, Allentown, all of Pa.

[73] Assignee: Air Products and Chemicals, Inc., Allentown, Pa.

[21] Appl. No.: 417,585

[22] Filed: Apr. 6, 1995

[51] Int. Cl.[6] ..... F26B 3/00

[52] U.S. Cl. ..... 34/516; 34/558; 34/567; 34/218; 62/51.1; 62/259.2

[58] Field of Search ..... 34/381, 389, 415, 34/417, 442, 443, 470, 471, 516, 535, 548, 558, 565, 567, 202, 210, 218; 62/48.1, 50.2, 78, 51.1, 259.2

[56] References Cited

U.S. PATENT DOCUMENTS

| | | | |
|---|---|---|---|
| 3,346,718 | 10/1967 | Cooley et al. | 62/48.1 X |
| 4,668,484 | 5/1987 | Elliott | 422/113 |
| 4,674,939 | 6/1987 | Maney et al. | 414/292 |
| 4,724,874 | 2/1988 | Parikh et al. | 141/98 |
| 4,739,882 | 4/1988 | Parikh et al. | 206/454 |
| 4,768,291 | 9/1988 | Palmer | 34/218 X |
| 4,804,086 | 2/1989 | Grohrock | 206/328 |
| 4,815,912 | 3/1989 | Maney et al. | 414/217 |
| 4,995,430 | 2/1991 | Bonora et al. | 141/98 |
| 5,210,959 | 5/1993 | Brestovansky et al. | 34/210 X |
| 5,351,415 | 10/1994 | Brooks et al. | 34/389 |

OTHER PUBLICATIONS

"Contamination control using a nitrogen–purged microenvironment", *Solid State Technology*, Nov. 1993, pp. 75–76.

Yabune, et al., "Isolation Performance of a Water Transportation System Having a Continuous $N_2$ Gas Purge Function," Proceedings, Institute of Environment Sciences, 1994, pp. 419–424.

CryoGas International (Mar. 1994).

MICROCONTAMINATION (Jan. 1994).

*Primary Examiner*—John M. Sollecito
*Assistant Examiner*—Steve Gravini
*Attorney, Agent, or Firm*—Geoffrey L. Chase

[57] ABSTRACT

A portable contamination-sensitive component transport container provides a continuously purged environment for the components. The container includes an attached cryogenically liquefied inert gas insulated storage vessel from which vaporized liquefied inert gas is used to generate a gaseous nitrogen purge to the container.

14 Claims, 2 Drawing Sheets

CRYOGENICALLY PURGED MINI ENVIRONMENT

TECHNICAL FIELD OF THE INVENTION

The present invention is an apparatus for transporting sensitive components, such as semiconductor wafers, in a high purity inert gas purged container to avoid contamination of the components during transport. The high purity inert gas is directly generated within the apparatus from liquefied inert gas.

BACKGROUND OF THE INVENTION

Minute amounts of contamination, including particles and molecular impurities can adversely affect the microchip fabrication process in the electronics industry. For example, adsorbed molecules such as water and oxygen can lead to undesired native oxide growth on a silicon wafer surface. Other molecular impurities, such as organics and metallics can reduce device performance and limit production yields.

Contaminants may be introduced to the fabrication process through deposition onto the surface of semiconductor wafers or other contamination sensitive devices, such as a glass mask substrates. Deposition may occur during transportation or storage of the wafers between processing steps. Semiconductor device fabrication can be enhanced by minimizing the rate of such deposition. The deposition rate can be reduced by transporting and storing the wafers in mini environment containers.

Semiconductor devices, such as silicon wafers must occasionally be carried or transported between destinations. Such devices are presently transported between clean locations in sealed containers. The protective containers are designed to prevent deposition of undesired particulate material on the clean wafer surfaces. The containers typically enclose an atmosphere of stagnant clean (filtered) air to surround the wafers. The particulate content of the clean air is minimized by installing the wafers in the container in a clean air environment. However, such stagnant clean air has been found to deposit small amounts of particulate matter on the wafers during transport. Also, the air contains large quantities of uncontrolled molecular impurities, such as ambient organic molecules, oxygen and water which may contaminate the wafers.

The most commonly used containers for semiconductor wafers consist of simple plastic boxes to enclose "boats" of wafers. The design of such containers may in some cases conform to SEMI Standard Mechanical InterFace (SMIF) requirements. However, such containers have been found to permit unacceptably high rates of contaminant deposition over time. Many contaminants may become sealed in the containers with the wafers. Also, contaminants may become released from the internal walls of the container over time. In most cases no internal gas purge or pressurization is provided to these containers. Therefore, additional contaminants may slowly enter the container through imperfect seals.

A recent improvement in wafer transporting uses nitrogen purging to create a higher purity, low particle level mini environment. One such container is marketed by Portable Clean Rooms. The container was advertised in the January 1994 issue of MICROCONTAMINATION and has been featured in Solid State Technology (November 1993) and CryoGas International (March 1994). This device uses pressurized gaseous nitrogen contained in an attached mini cylinder to provide a continuous filtered purge to the container. The wafer container is constructed primarily from plastic. A related patent (U.S. Pat. No. 4,668,484) has been filed by the manufacturer. A compressed gas cylinder is mounted above the wafer container. The gas cylinder is not intended to be re-used. It must be discarded when empty. A replacement cylinder must then be purchased. The system is intended to be used for semiconductor wafer storage and for carrying wafers between clean locations. The container is designed to contain 50 to 200 mm diameter silicon wafers. The container includes a pressure switch and an LED indicator connected to the wafer container. The indicator blinks when the switch senses positive pressure in the container. The system is 54 cm tall, with a 17 cm×24 cm footprint. The (unloaded) weight of the system is 4,740 gm (10 pounds). Useful purge life, flowrates and nitrogen storage capacity are given in a specification release, "The Portable Clean Room™ Wafer Transport System" by Portable Clean Rooms.

A similar purged container for silicon wafers was described by Yabune, et al., "Isolation Performance of a Wafer Transportation System Having a Continuous $N_2$ Gas Purge Function", Proceedings, Institute of Environmental Sciences, 1994, pp 419–424. The Yabune, et al., container also uses an attached mini cylinder of pressurized nitrogen to purge the wafer container. The Yabune, et al., system uses an aluminum container and a high purity all-metal gas distribution system. Yabune, et al., have demonstrated a reduction in native oxide growth rate and an improved device performance when the purged storage system is used.

Asyst Technologies, Inc. markets SMIF pods for silicon wafers and other semiconductor devices. The Asyst device does not provide for continuous purging of the pods. However, the Asyst device provides an optional pod sealing system which encloses pressurized nitrogen inside the pod. The positive pressure is intended to minimize exposure of the wafers to external molecular and particulate contaminants. However, the pure environment cannot be maintained indefinitely. Imperfect seals cause the internal pressure of the pod to decay over a period of time. See SMIF-Pods, Asyst Technologies, Document #2100-1015-01.

U.S. Pat. No. 5,351,415 discloses a container for storage or transport of semiconductor wafers that uses ionized gas, such as gaseous nitrogen. The nitrogen is supplied from a cylinder of compressed gas that is typical in the industry. The compressed gas cylinder is not affixed to the container, but is connected through a gas line.

The prior art has attempted to provide a solution to the problem of storing and transporting contamination-sensitive components, such as semiconductor wafers, in a human operator transportable container. However, the prior attempts suffer from limited capacity of inerting gas available for such containers, the limitation on the purity of the inerting gas particularly on a steady state basis during use of the capacity of inert gas available, the inability to vary the rate of inert gas flow, and the lack of refill capability. The present invention, as described below, overcomes all of these disadvantages of the prior art as will be described in greater detail.

BRIEF SUMMARY OF THE INVENTION

The present invention is a portable transport container for transporting various contamination-sensitive components under high purity conditions while purging the container with high purity inert gas to maintain such high purity conditions, comprising:

(a) a chamber for containing the various components in spaced relationship one to another, wherein the chamber has a first orifice for admitting the high purity inert gas, a closeable aperture for inserting and removing the components in the chamber, and a second orifice for controllably releasing the high purity inert gas from the chamber, the second orifice designed to maintain an elevated pressure in the chamber in relation to the flow of high purity inert gas through the first orifice;

(b) an insulated storage vessel mounted on the chamber for storing a quantity of liquefied high purity inert gas, the insulated storage vessel having sufficient heat leak through its walls to controllably vaporize the liquefied high purity inert gas, wherein the insulated storage vessel has at least one opening in its upper region for filling the insulated storage vessel with liquefied high purity inert gas and dispensing vaporized high purity inert gas from the liquefied high purity inert gas, wherein the opening is above the level of the liquefied high purity inert gas when the vessel is filled with the liquefied high purity inert gas;

(c) a conduit communicating between the opening in the insulated storage vessel and the first orifice in the chamber to dispense vaporized high purity inert gas from the insulated storage vessel to the chamber under elevated pressure.

Preferably, the insulated storage vessel contains an electric heating element to assist in vaporizing the liquefied high purity inert gas, wherein the electric heating element is connected to a controller and an electric power source to controllably operate the electric heating element to vary the vaporization of the liquefied high purity inert gas.

Preferably, the means for indicating the level of liquefied high purity inert gas comprises a calibrated spring mounting for the insulated storage vessel that is displaced by the weight of the insulated storage vessel and contained liquefied high purity inert gas and a level gauge associated with the insulated storage vessel. Alternatively, the insulated storage vessel has a means for indicating the level of liquefied high purity inert gas contained in the insulated storage vessel. More preferably, the means for indicating the level of liquefied high purity inert gas comprises an assembly positioned in the insulated storage vessel containing a float at its lower end and a graduated scale at its upper end connected by an arm so as to communicate the level achieved by the float in the liquefied high purity inert gas on the graduated scale by a pointer affixed to the arm.

Preferably, the chamber contains a rack for holding the various components in spaced relationship one to another.

Preferably, the chamber has an outer shell attached to the chamber for containing the insulated storage vessel above the chamber.

Preferably, the second orifice has a spring loaded pressure valve designed to maintain approximately 1 psig of positive pressure in the chamber.

Preferably, the conduit contains a filter for removing particulates from the high purity inert gas.

Preferably, the electric heating element is a resistor wire which is electrically connected in a circuit comprising a battery as an electric power source, an on-off switch and a potentiometer to control the temperature of the electric heating element.

The present invention is also a method for transporting various contamination-sensitive components under high purity conditions in a portable transport container while purging the container with high purity inert gas to maintain such high purity conditions, comprising:

(a) placing the contamination-sensitive components in a chamber for containing the components in spaced relationship one to another, wherein the chamber has a first orifice for admitting the high purity inert gas, a closeable aperture for inserting and removing the components in the chamber, and a second orifice for controllably releasing the high purity inert gas from the chamber, the second orifice designed to maintain an elevated pressure in the chamber in relation to the flow of high purity inert gas through the first orifice;

(b) maintaining a quantity of liquefied high purity inert gas in an insulated storage vessel mounted on the chamber, the insulated storage vessel having sufficient heat leak through its walls to controllably vaporize the liquefied high purity inert gas, wherein the insulated storage vessel has at least one opening in its upper region for filling said insulated storage vessel with liquefied high purity inert gas and dispensing vaporized high purity inert gas from the liquefied high purity inert gas, wherein the opening is above the level of the liquefied high purity inert gas when the vessel is filled with the liquefied high purity inert gas;

(c) dispensing vaporized high purity inert gas from the liquefied high purity inert gas through a conduit communicating between the opening in the insulated storage vessel and the first orifice in the chamber to dispense vaporized high purity inert gas from the insulated storage vessel to the chamber under elevated pressure to purge the chamber and the contamination-sensitive components and reduce the contamination of the components stored in the chamber.

Preferably, the liquefied high purity inert gas is selected from the group consisting of nitrogen, argon, helium and mixtures thereof.

Preferably, the liquefied high purity inert gas is heated to increase its vaporization rate by an electric heating element in the insulated storage vessel.

Preferably, the vaporized high purity inert gas is filtered before it enters the chamber.

DETAILED DESCRIPTION OF THE INVENTION

Figure 1:
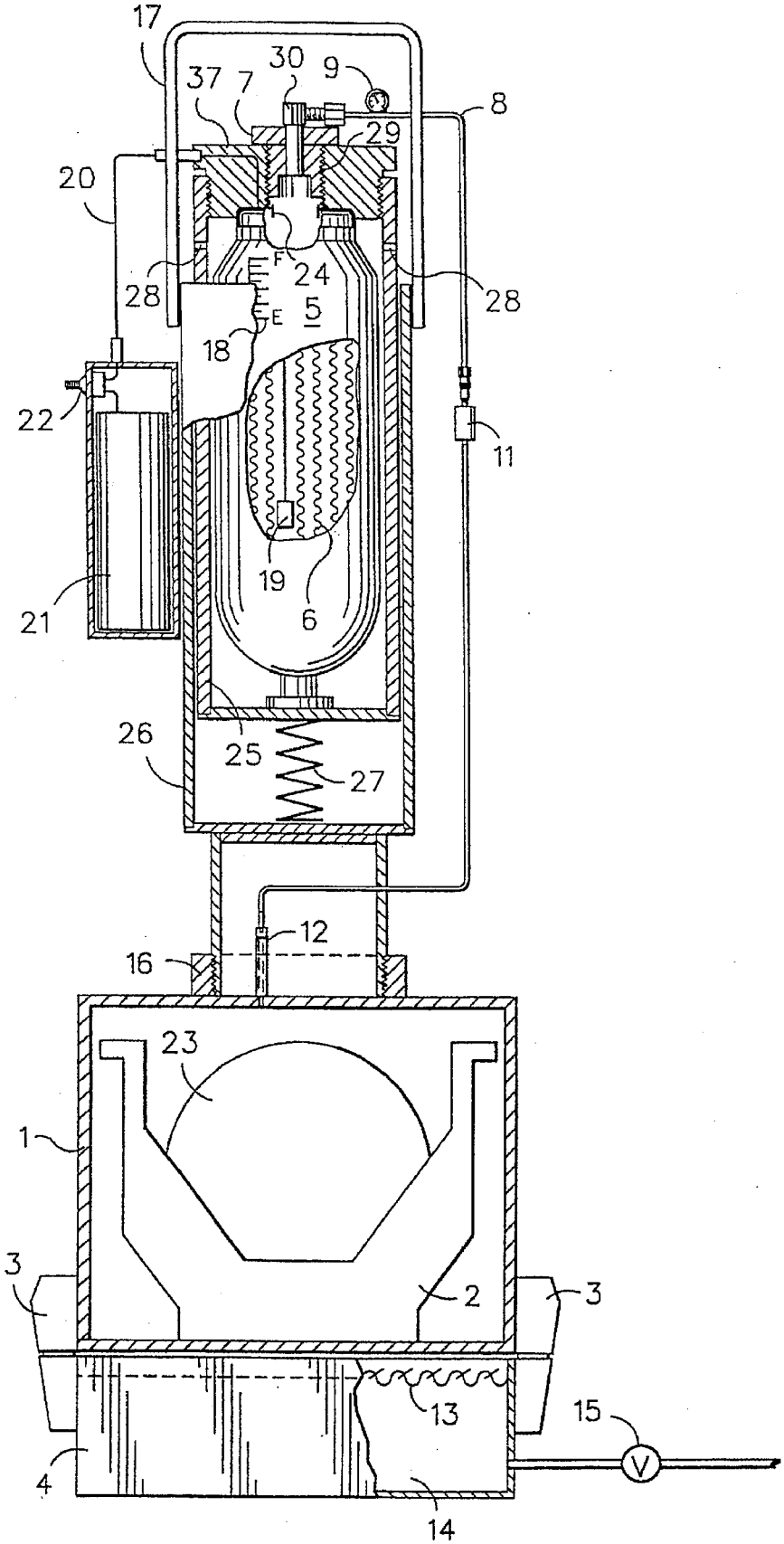
FIG. 1 is a schematic cross-section of a preferred embodiment of the present invention.

The present invention is a new type of contamination-sensitive component (i.e., semiconductor wafer) portable transport container. The new container reduces contaminant deposition rate by providing a continuously purged environment for the component or semiconductor wafers. The new container includes an attached liquid (cryogen) inert gas storage vessel for containing a cryogenically liquefied inert gas, such as nitrogen (LIN), argon (LAR), helium or other inert gas. For the purposes of the present invention, an inert gas is a gas at ambient or process conditions which does not have any significant effect on the contamination-sensitive components or semiconductor wafers transported in the container. Inert gas vaporized from the cryogenic liquid is used to generate a high purity inert gas purge to the chamber of the container containing the contamination-sensitive component. For the purpose of the present invention, high purity is a particulate level less than 10 per cubic foot, preferably less than 1 per cubic foot, optimally less than 0.1 per cubic foot for particles larger than 0.1 micrometer, and an oxygen level less than 2 ppm, preferably less than 100 ppb, optimally less than 20 ppb. Total impurities would be less than 20 ppm, preferably less than 1 ppm, optimally less than 300 ppb. The liquefied cryogenic inert gas provides a source of purer inert gas than is commonly available in non-purified compressed gaseous nitrogen sources. Active purging of the chamber of the container provides an internal atmosphere having significantly lower levels of contamination. Such lower contamination levels may reduce deposition of contamination on the wafer surfaces.

A liquid source for purge gas permits larger quantities of inert gas to be stored on board the transport container. Larger inert gas quantities permit higher purge flow rates or a longer purge period before refill. Higher flow rates provide quicker inerting of the container's internal atmosphere following installation of the components or semiconductor wafers. Higher flow rates also maintain a lower level of contamination inside the container when minute leaks are present or when contaminants are released from the internal surfaces of the container. Therefore, the liquid source of inert gas of the present invention is superior to a compressed gas source of the prior art.

The present invention utilizes an insulated storage vessel for the storage of the cryogenically liquefied high purity inert gas. Such vessels are typically referred to in the industry as dewars. The dewar of the present invention has an opening at its upper region or preferably its top to fill and refill the supply of liquefied high purity inert gas. The dewar has insulating walls to maintain the liquid physical state of the gas as long as possible within the desire to have controlled vaporization to the gaseous physical state. The insulated walls of the dewar can be a mirrored surface which reflects heat or it can be a lamination with low R-value or heat leak, such as closed cell materials or foams. Double walled construction with vacuum or inert gas is possible.

The improved portable transport container design of the present invention replaces the prior art pressurized gaseous nitrogen cylinder with a small insulated cryogenic liquefied high purity inert gas source. The design is shown schematically in FIG. 1. The portable transport container of the present invention has a chamber 1 enclosing the silicon wafers or other contamination-sensitive components 23 in rack 2 for holding such components in spaced relationship one to another. The chamber 1 is attached by mechanical fasteners 3 to the chamber bottom 4. The bottom 4 covers the closeable aperture of the chamber 1 comprising the under side or base of the chamber, which is open to the bottom. This aperture allows the components or wafers to be inserted into and removed from the chamber. A small thermally insulated storage vessel or dewar 5 containing cryogenic liquefied high purity inert gas, such as liquid nitrogen (LIN) or liquid argon (LAR), is mounted to the top of the chamber 1. The storage vessel 5 is contained in a sleeve 25, which is mounted on a balance spring 27 inside an outer shell 26. Sleeve 25 is vented by one or more vents 28 in the event the inert gas vaporizes more quickly than can be handled otherwise, such as if liquid spills from the vessel or dewar 5. The storage vessel 5 and the sleeve 25 are rigidly affixed to one another, but vertically movably contained in the outer shell 26 so that the assembly of the vessel 5 and the sleeve 25 move as one vertically within the outer shell 26 to have a calibrated vertical displacement on the balance spring 27. This displacement is referenced to the top edge of the outer shell 26 by a calibrated gauge 18 on the storage vessel or dewar 5, or alternatively on the sleeve 25, to provide a reading of the relative fill of cryogenic liquefied high purity inert gas in the vessel. The LIN can be kept from sloshing during transport by using a submerged mesh or honeycomb-like packing 6. The vessel or dewar is provided with an opening or other means 24 to refill expended LIN through closure 37, which engages the outer shell 26 typically by threaded interface so that as the closure is threaded on to the outer shell, its lower face sealably engages the top of the storage vessel. The opening 24 and the cooperating opening 29 in closure 27 is closed by an appropriate cap 7. The opening 24 is situated on the upper region or preferably the top of the storage vessel 5 above the level of the liquefied inert gas at the full refill level. The LIN continuously boils and vaporizes to generate high purity inert gas for purge utilization through natural heat leak into the dewar. The cold, gaseous nitrogen exits the vessel or dewar through conduit 8, which is removably inserted in cap 7 by a friction engaging plug insert 30. The conduit may contain a pressure sensing device 9. The nitrogen is warmed to ambient temperature as it flows through conduit 8. Warming is provided by natural heat leak into the conduit.

The nitrogen is filtered by an in-line filter 11. The clean nitrogen enters the chamber 1 at dispenser 12 constituting a first orifice in the chamber and flows continuously across the wafers or other contamination-sensitive components 23. The nitrogen thus provides a continuous high purity purge to the chamber during storage or transport. The purge nitrogen exits the bottom 4 of the chamber by flowing through a flow equalizing mesh 13 and into a plenum area 14. The nitrogen then flows through a spring-loaded pressure valve 15 and is vented. The mesh 13, plenum 14 and valve 15 as an assembly together constitute a second orifice in the chamber for maintaining an elevated pressure in the chamber 1. The valve 15 is set to provide a slight positive pressure (e.g., 1 psig or less) to the inside of the chamber. The slight positive pressure minimizes ingress of particulate and other impurities, such as oxygen gas, into the container from the outside environment.

The vessel or dewar, conduit, sleeve and outer shell assembly is removable from the transport container and the chamber. The assembly is attached to the chamber 1 through the outer shell using mechanical fastener 16. The fastener may utilize a screw-on or clip-on or other appropriate means to attach the assembly. A handle 17 is provided to permit carrying of the assembly. When the LIN source assembly is detached from the wafer storage chamber, the wafer storage chamber may be provided with filtered nitrogen from another external gas source (not shown in the schematic diagram).

An alternative to the level sensor consisting of a spring operated gravimetric device (spring scale) to monitor the total weight of the dewar and contained LIN illustrated in FIG. 1 as liquid level sensing assembly 18 is, for example, a float indicator mounted in the opening of the storage vessel not shown in FIG. 1, which would also function to provide a means to determine when LIN must be added to the dewar.

The flow rate of gaseous nitrogen across the contamination-sensitive components or semiconductor wafers is determined by the boiling rate of the LIN in the dewar 5. The minimum boiling rate is determined by the rate of natural heat leak into the dewar. If desired, the boiling rate can be increased using, for example, an electrical resistance heating element or resistor wire 19 submerged in the LIN dewar. The resistance heating element is connected through wires 20 to an electric power source 21. The power source may consist of rechargeable batteries, solar panels or other portable power source. The power to the resistance heating element may be set using power controller 22. The controller 22 can include an on-off switch and a potentiometer to control electric current to the heating element 19. (The LIN boiling rate may also be controlled using, for example, adjustable heat fins protruding into the LIN to vary the rate of heat leak into the dewar.)

The power P(watts) required to boil LIN is given by P=L M, where L is the heat of vaporization of LIN (~200 watt-sec/gm at 1 atm pressure) and M is the desired boiling rate (gm/sec). For example, the power required to boil 0.019 gm/sec of LIN is (200×0.019) watt=3.87 watts. This boiling rate (0.019 gm/sec) corresponds to a gaseous nitrogen flow rate of 1,000 standard $cm^3$/minute (1 standard liter per minute). Rechargeable batteries can provide power sufficient to produce more than 1 liter per minute gaseous nitrogen flow.

The total energy required to boil an entire 1 liter (808 gm) of LIN is 200 watt-sec/gm ×808 gm=161,600 watt-sec=45 watt-hr. Two standard camcorder batteries, having a total weight of approximately 2.4 lbs can provide more than the required 45 watt-hr between recharges.

The improved transport container differs from the prior art in replacing pressurized gaseous nitrogen with unpressurized, liquid nitrogen or other liquefied cryogenic inert gas, such as argon. More inert gas can be stored on board the transport container when in the liquid form. For example, the commercially available pressurized gas device can contain 58 standard liters (67 gm) nitrogen. In comparison, a 1 liter LIN source provides 696 standard liters (808 gm) gaseous nitrogen in a small volume. Small physical size is important when designing wafer transport containers that must be carried by hand.

The apparatus of the present invention used to contain, vaporize, filter and deliver the nitrogen purge can be made small and light in the described design. Since 1 liter of LIN weighs only 808 gm (1.78 pounds), the entire transport container can be practically designed with a total weight of less than 15 pounds. The prior art pressurized nitrogen gas transport container weighs approximately 10 pounds. However as will be set forth below, the present invention provides much better purge rate, lower impurity levels and easier refill and operating cost than the gaseous source containers.

The total operating time of the cryogenic liquefied inert gas purged transport container of the present invention between charges depends upon the boil-off rate of the liquefied inert gas. The boil-off rate depends upon the rate of heat leak into the insulated storage vessel or dewar. Boil-off rate measurements have been made using glass-lined Thermos™ vessels. The vessels were located in a laboratory environment at ambient temperature. These vessels are commercially available and inexpensive. From these measurements it was estimated that a well insulated 1 liter (808 gm) inventory of LIN can sustain nitrogen flow across the semiconductor wafers for as long as about three days (72 hours).

The LIN consumption rate described above would provide an average flow of 160 $cm^3$/minute gaseous nitrogen across the semiconductor wafers. Higher flow rates could also be created for shorter operating periods by increasing the heat input to the storage vessel or dewar. In comparison, the prior art pressurized gas device contains an inventory of only 67 gm gaseous nitrogen. For the same operating time of 72 hours, the available purge flow rate of the prior art compressed gas device is only 13 $cm^3$/minute. Therefore, with an inventory of only 67 gm nitrogen, the prior art pressurized gas device provides an average purge flow rate only 8% (1/12th) that of a 808 gm LIN storage vessel as is used in the present invention's transport container.

An increased purge flow rate tends to reduce the level of contamination in a purged vessel having imperfect seals. This reduced contamination occurs because any molecular impurities or particles ingressing through leaks to the vessel or released from the internal surfaces of the vessel are more rapidly swept away by the higher velocity purge gas. Since a 1 liter LIN storage vessel, such as in the present invention, can provide a purge flow rate (and sweep velocity) 12 times that of the prior art compressed gas device, the LIN supplied transport container of the present invention can provide lower levels of contamination in the purged chamber where contamination-sensitive components, such as semiconductor wafers are carded or stored. Lower levels of contamination in the mini environment of the transport container results in lower surface contamination on the contamination-sensitive component or semiconductor wafer.

EXAMPLE

Gaseous house nitrogen was purged through a Plexiglas™ silicon wafer box having an internal volume of 5,300 $cm^3$. The purge nitrogen had an oxygen fraction of less than 1 ppm. The box initially contained air. The oxygen fraction in the box outlet vent was continuously measured using an oxygen detector. Even though the internal pressure of the box was held at ~1-inch water (0.04 psig) during the test, the box had imperfect seals which permitted continuous diffusion of molecular contamination, including oxygen from the surrounding air.

Figure 2:
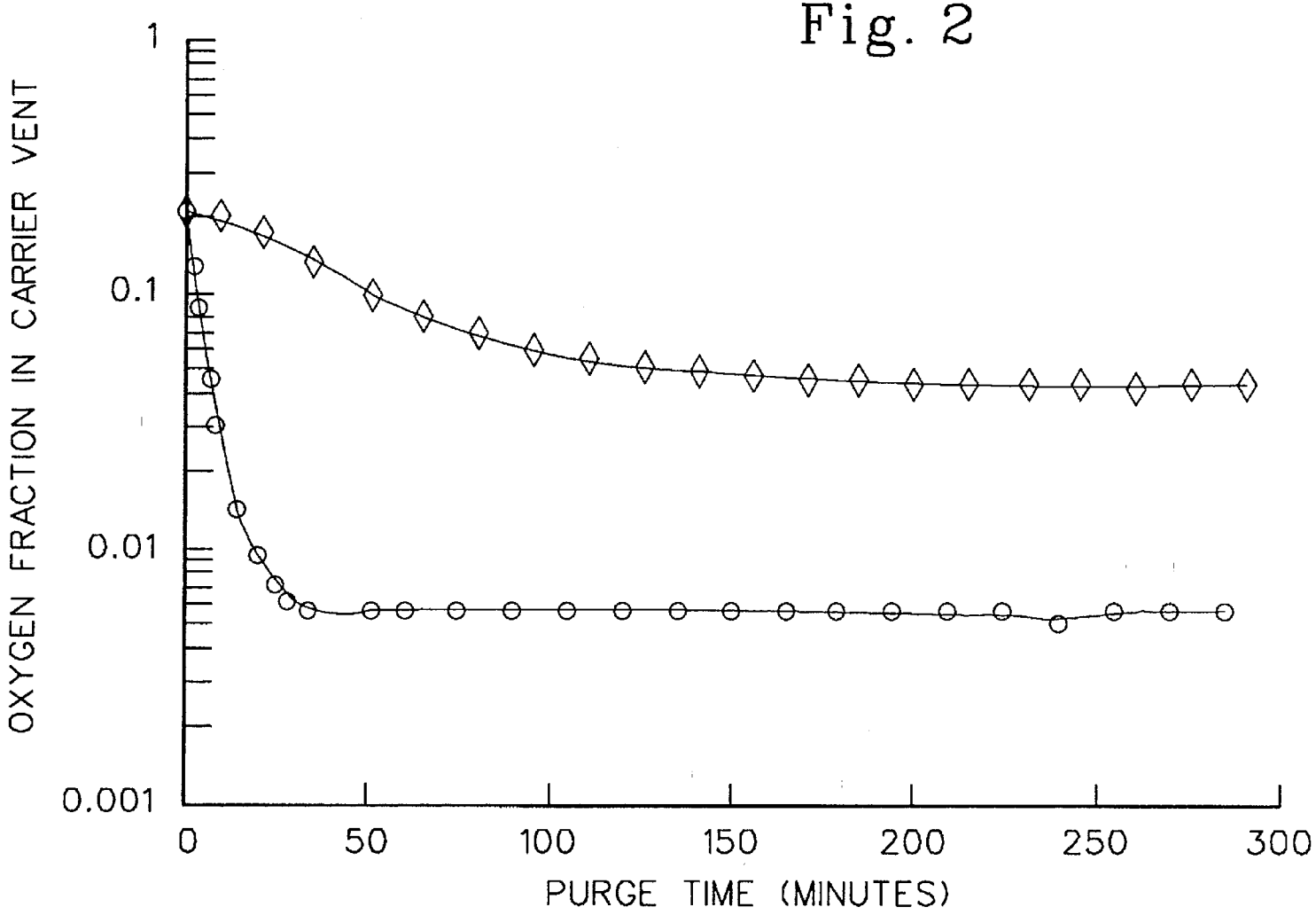
FIG. 2 is a graph of oxygen fraction in exhaust gas from a transport container versus purge time in minutes for two different purge rates; 83 cu.cm./min. and 1000 cu. cm./min. representative of the prior art and the present invention, respectively.

FIG. 2 shows the results of the test. When the box was purged at a flow rate of 1,000 standard $cm^3$/minute, the oxygen fraction fell to a steady value of 0.0055 (5,500 ppm). The high purge rate allowed the box to achieve this level in only about 30 minutes. When the box was purged at a lower flow rate of 83 standard $cm^3$/minute (1/12th the first flow rate), the oxygen fraction fell to a steady value of 0.043 (43,000 ppm) and a much longer time was required to achieve the steady value.

Oxygen was continuously diffusing into the box through imperfect seals. The lower purge rate in this example provided less dilution to the ingressing oxygen. This lower dilution resulted in the higher steady value of oxygen contamination in the box. Therefore, when imperfect seals are present, and when a lower flow rate purge device is used, the semiconductor wafers will be exposed to increased contamination for a longer period of time. This increased exposure may result in increased surface contamination and undesired native oxide growth on wafers. Since the design of the transport container of the present invention can provide a purge flow rate twelve times that of the prior art pressurized gas device, the semiconductor wafers are better protected from ingressing contaminants using the transport container of the present invention.

FIG. 2 also shows a faster approach to the steady contamination level when using a higher purge rate. Therefore, the improved design of the present invention can more quickly inert the internal atmosphere of the transport container than a lower purge rate design. When the atmosphere is inerted more quickly, the semiconductor wafers are exposed to contamination for a shorter period of time following placement in the container. The time required to approach the steady state contamination level can be predicted by assuming the atmosphere is well mixed inside the container. When there are no container leaks, the fraction of contamination C in the container is given by the exponential:

$$(C-Cin)/(Co-Cin)=exp\{-Q\ t/V\}$$

where Cin is the fraction of contamination in the incoming purge gas (less than 1 ppm oxygen in this case), Co is the initial fraction of contamination in the box (0.21=210,000 ppm oxygen in this example), Q is the purge flow rate ($cm^3$/minute), t is time (minutes) and V is the volume of the container (5,300 $cm^3$ in this example.) The time constant of the decay curve is V/Q. Therefore, a higher purge rate Q results in a lower time constant and a faster approach to the steady level. The present invention provides a twelve times higher purge rate than the prior art, leading to a twelve times lower time constant. The lower time constant provides less exposure of the semiconductor wafers to contamination following installation in the transport container.

The high purity inert gas purge must be maintained at the highest possible purity in order to minimize contamination of the wafers. Prior art container designs do not include a point of use purifier on the compressed gas source. Such a purifier would increase the cost and weight of the device. Also, in a conventional gas cylinder, the moisture and impurity concentrations increase as the cylinder pressure decreases. The impurity increase results from continuous outgassing of adsorbed or absorbed impurities from the cylinder's internal surfaces with decreasing pressure in the cylinder. As the cylinder pressure decreases, the amount of nitrogen available in the cylinder to dilute the outgassing contaminants decreases, resulting in higher contamination levels.

However, cryogenically liquefied inert gas provides a source of purer inert gas than is available in non-purified compressed gaseous nitrogen sources. This high purity results from the fact that condensable impurities, such as water and organic substances, are largely left in the frozen state in the liquefied inert gas reservoir as the lower boiling point inert gas, such as nitrogen, vaporizes. That is, the vapor pressure of the condensable impurities is low at the temperature of all contemplated cryogenically liquefied inert gases. For example, the concentration of oxygen in boiled nitrogen emerging from a simple glass dewar was measured to be less than 0.0001 (less than 100 ppm). (Also, at the normal boiling point of LIN, −196° C., the theoretical moisture content in the vapor is below 1 ppb.) This concentration level is maintained for as long as there is LIN in the dewar and the dewar remains cold; there is no progressive increase in contamination level over time, as in the case of the prior art pressurized cylinder. This analysis is also true for other cryogenically liquefied inert gases, such as argon, helium and mixtures thereof. As a result, the present invention can offer consistent high purity in inert gas purge flow through the chamber where contamination-sensitive components are carried, such as semiconductor wafers, over the full range of the liquefied inert gas supply, while the prior art compressed gas supply is inconsistent in purity and in fact should degrade in purity as the compressed gas is consumed, the pressure drops in the supply and impurities outgas or desorb from the supply container.

Thus the present invention design provides a potentially purer purge gas for the transport container than does the prior art. Such lower levels of molecular impurities tend to result in lower surface contamination on a contamination-sensitive component or semiconductor wafer.

Finally, a comparison was made of the prior art transport container using compressed nitrogen gas as exemplified by the commercial embodiment of U.S. Pat. No. 4,668,484 and the transport container of the present invention using cryogenically liquefied nitrogen as the source of the high purity inert gas. The results of the comparison are reported in Table 1 below.

TABLE 1

Operating Cost and Performance Comparison
Compressed Gas Mini Environment vs. LIN Dewar Mini Environment

| | Prior Art Compressed Gas Cylinder 67 gm Nitrogen | Invention Liquid Nitrogen Dewar 808 gm Nitrogen | Comment |
|---|---|---|---|
| Gaseous Nitrogen Capacity | 58 standard liters | 696 standard liters | LIN dewar provides more on-board nitrogen |
| Nitrogen Life* | 58 minutes | 696 minutes | LIN dewar provides longer duty cycle |
| Operating Cost per Duty Cycle | $67** | $0.41*** | LIN dewar does not require disposable gas cylinder |
| Operating Cost per Minute* | $1.16** | $0.000594*** | LIN dewar substantially more economical to operate |
| Operating cost per gm Nitrogen | $1.16** | $0.000512*** | |
| Mini Environment Height | 54 cm | 67 cm | LIN dewar prototype requires more height |
| Mini Environment Weight (no wafers) | 10 pounds (4740 gm) | 15 pounds (6830 gm) | LIN dewar prototype requires more weight |
| gm Nitrogen per gm Mini Environment | 0.014 | 0.118 | LIN dewar carries more nitrogen per unit weight of apparatus |

*Based on 1000 cu cm/minute flow rate - values for other flow rates scale accordingly.
**Includes cost of expendable mini gas cylinder and nitrogen.
***Includes cost of LIN only.

As can be seen from the table, the present invention can accommodate more total inert gas, for a longer total purge time, at lower operating cost from three separate perspectives, including: cost per cycle of gas supply, cost per minute of use and cost per weight of inert gas. Therefore, the overall cost of ownership of the present invention is substantially lower than that of the commercial embodiment of U.S. Pat. No. 4,668,484. Although the overall size and weight of the embodiment of the present invention compared to the prior art was greater, the size and weight are still within the parameters acceptable for human operator handling and the ratio of grams of inert gas to grams of the transport container are favorable to the present invention and demonstrate a considerable weight efficiency of the present invention over the prior art.

As a result, the present invention has overcome several significant deficiencies in the prior art of contamination-sensitive component transport containers. The present invention uses a refillable insulated storage vessel that can be used with cryogenically liquefied inert gas. More total gas can be stored in the vessel of the present invention. The purity of the liquefied inert gas is greater over the supply life of the present invention. The rate of purge gas flow can be easily controlled by an electric heater element to provide higher purge rates over sustained time periods than the prior art and therefore higher purity in the chamber where the components or wafers are actually stored. These advantages represent significant and unexpected advantages in transport containers over the prior art.

The present invention has been set forth in one or more specific embodiments, however the scope of the present invention should be ascertained by the claims which follow.

We claim:

1. A portable transport container for transporting various contamination-sensitive components under high purity conditions while purging said container with high purity inert gas to maintain such high purity conditions, comprising:

(a) a chamber for containing said various contamination-sensitive components in spaced relationship one to another, wherein said chamber has a first orifice for admitting said high purity inert gas, a closeable aperture for inserting and removing said components in said chamber, and a second orifice for controllably releasing said high purity inert gas from said chamber, said second orifice designed to maintain an elevated pressure in said chamber in relation to the flow of high purity inert gas through said first orifice;

(b) an insulated storage vessel mounted on said chamber capable of storing a quantity of liquefied high purity inert gas, said insulated storage vessel having sufficient heat leak through its walls to controllably vaporize said liquefied high purity inert gas, wherein said insulated storage vessel has at least one opening in its upper region for filling said insulated storage vessel with liquefied high purity inert gas and dispensing vaporized high purity inert gas from said liquefied high purity inert gas wherein said opening is above the level of the liquefied high purity inert gas when said vessel is filled with said liquefied high purity inert gas;

(c) a conduit communicating between said opening in said insulated storage vessel and said first orifice in said chamber to dispense vaporized high purity inert gas from said insulated storage vessel to said chamber under elevated pressure.

2. The apparatus of claim 1 wherein said insulated storage vessel contains an electric heating element to assist in vaporizing said liquefied high purity inert gas, wherein said electric heating element is connected to a controller and an electric power source to controllably operate said electric heating element to vary the vaporization of said liquefied high purity inert gas.

3. The apparatus of claim 1 wherein said insulated storage vessel has a means for indicating the level of liquefied high purity inert gas contained in said insulated storage vessel.

4. The apparatus of claim 3 wherein said means for indicating the level of liquefied high purity inert gas comprises an assembly positioned in said insulated storage vessel containing a float at its lower end and a graduated scale at its upper end connected by an arm so as to communicate the level achieved by the float in said liquefied high purity inert gas on said graduated scale by a pointer affixed to said arm.

5. The apparatus of claim 3 wherein said means for indicating the level of liquefied high purity inert gas comprises a calibrated spring mounting for said insulated storage vessel that is displaced by the weight of said insulated storage vessel and contained liquefied high purity inert gas and a level gauge associated with said insulated storage vessel.

6. The apparatus of claim 1 wherein said chamber contains a rack for holding said various components in spaced relationship one to another.

7. The apparatus of claim 1 wherein said chamber has an outer shell attached to said chamber for containing said insulated storage vessel above said chamber.

8. The apparatus of claim 1 wherein said second orifice has a spring loaded pressure valve designed to maintain approximately 1 psig of positive pressure in said chamber.

9. The apparatus of claim 1 wherein said conduit contains a filter for removing particulates from said high purity inert gas.

10. The apparatus of claim 2 wherein said electric heating element is a resistor wire which is electrically connected in a circuit comprising a battery as an electric power source, an on-off switch and a potentiometer to control the temperature of the electric heating element.

11. A method for transporting various contamination-sensitive components under high purity conditions in a portable transport container while purging said container with high purity inert gas to maintain such high purity conditions, comprising:

(a) placing said contamination-sensitive components in a chamber for containing said components in spaced relationship one to another, wherein said chamber has a first orifice for admitting said high purity inert gas, a closeable aperture for inserting and removing said components in said chamber, and a second orifice for controllably releasing said high purity inert gas from said chamber, said second orifice designed to maintain an elevated pressure in said chamber in relation to the flow of high purity inert gas through said first orifice;

(b) maintaining a quantity of liquefied high purity inert gas in an insulated storage vessel mounted on said chamber, said insulated storage vessel having sufficient heat leak through its walls to controllably vaporize said liquefied high purity inert gas, wherein said insulated storage vessel has at least one opening in its upper region for filling said insulated storage vessel with liquefied high purity inert gas and dispensing vaporized high purity inert gas from said liquefied high purity inert gas, wherein said opening is above the level of the liquefied high purity inert gas when said vessel is filled with said liquefied high purity inert gas;

(c) dispensing vaporized high purity inert gas from said liquefied high purity inert gas through a conduit communicating between said opening in said insulated storage vessel and said first orifice in said chamber to dispense vaporized high purity inert gas from said insulated storage vessel to said chamber under elevated pressure to purge said chamber and said contamination-sensitive components and reduce the contamination of said components stored in said chamber.

12. The method of claim 11 wherein the liquefied high purity inert gas is selected from the group consisting of nitrogen, argon, helium and mixtures thereof.

13. The method of claim 11 wherein the liquefied high purity inert gas is heated to increase its vaporization rate by an electric heating element in said insulated storage vessel.

14. The method of claim 11 wherein said vaporized high purity inert gas is filtered before it enters said chamber.

* * * * *